US006670590B1

(12) United States Patent
Pacholok et al.

(10) Patent No.: US 6,670,590 B1
(45) Date of Patent: Dec. 30, 2003

(54) EDDY CURRENT/HYSTERETIC HEATER APPARATUS

(76) Inventors: David R. Pacholok, 1815 Higgins Rd., Sleepy Hollow, IL (US) 60118; Thomas M. Gough, 583 Running Deer La., Gilberts, IL (US) 60136

( * ) Notice: Subject to any disclaimer, the term of this patent is extended or adjusted under 35 U.S.C. 154(b) by 0 days.

(21) Appl. No.: 10/171,224

(22) Filed: Jun. 13, 2002

Related U.S. Application Data

(62) Division of application No. 09/722,235, filed on Nov. 27, 2000.

(51) Int. Cl.[7] ..... H05B 6/14; H05B 6/06

(52) U.S. Cl. ..... 219/635; 219/662; 219/665; 219/676

(58) Field of Search ..... 219/635, 656, 219/660, 661, 665, 662, 670, 672, 676, 673, 675, 633

(56) References Cited

U.S. PATENT DOCUMENTS 2,882,378 A * 4/1959 Ticehurst ..... 219/656
4,017,701 A * 4/1977 Mittelmann ..... 219/635
4,492,840 A * 1/1985 Lex ..... 219/635
4,521,659 A * 6/1985 Buckley et al. ..... 219/670
4,899,025 A * 2/1990 Kamp et al. ..... 219/662
5,821,504 A * 10/1998 Sprenger et al. ..... 219/635
5,977,527 A * 11/1999 Preston et al. ..... 219/635
6,288,375 B1 * 9/2001 Lappi et al. ..... 219/633

FOREIGN PATENT DOCUMENTS

JP 62-186970 * 8/1987

* cited by examiner

*Primary Examiner*—Philip H. Leung
(74) *Attorney, Agent, or Firm*—Kajane McManus

(57) ABSTRACT

The method and apparatus are for use in automotive vehicle repair, both mechanical and body. The apparatus includes at least an eddy current/hysteretic circuit and at least one applicator functionally engaged to the circuit for obtaining a desired result when the applicator is placed into contact with structure of the vehicle to be affected by heating thereof.

13 Claims, 4 Drawing Sheets

EDDY CURRENT/HYSTERETIC HEATER APPARATUS

CROSS REFERENCE TO RELATED APPLICATIONS

This application is a division of U.S. application Ser. No. 09/722,235, filed Nov. 27, 2000, of the same title.

BACKGROUND OF THE INVENTION

Field of the Invention

The present invention relates to an eddy current/hysteretic heater apparatus and its method of use. More specifically the eddy current/hysteretic heater apparatus is proposed for application in the field of automotive vehicle repair and the method of using the apparatus in the field relates to use in both mechanical and body repairs.

PRIOR ART

It has not heretofore been proposed to use eddy current/hysteretic heating in a variety of automotive repair applications, nor has applicability thereof to the field been recognized.

The apparatus and method of use to be described hereinbelow are thus believed to be novel.

SUMMARY OF THE INVENTION

According to the invention there is provided an eddy current/hysteretic heater apparatus for use in the automotive repair comprising at least an eddy current/hysteretic circuit having at least one applicator functionally engaged thereto for use in applying heat to a desired area of an automotive vehicle.

Further according to the invention there is provided a method for producing eddy current/hysteretic heating at an area of a body of an automotive vehicle using an eddy current/hysteretic heater having at least one heat applicator functionally engaged to an eddy current/hysteretic circuit of the heater to remove dents, flaws, adhesively bonded automotive parts such as side moldings and window glass, and any other structural defects affected by heat from the automotive vehicle body, the method comprising the steps of engaging the eddy current/hysteretic circuit to a suitable power source; engaging a suitable applicator to the circuit in a functional manner; powering the circuit on; and placing the applicator in contact with an area of the body of the automotive vehicle to which it is desired to apply heat; and if required, moving the applicator along the body until a desired result is achieved.

Still further a method for eddy current/hysteretic heating of a mechanical structure of an automotive vehicle using an eddy current/hysteretic heater having at least one heat applicator functionally engaged to an eddy current/hysteretic circuit of the heater for at least loosening the mechanical structure for removal thereof, the method comprising the steps of engaging the eddy current/hysteretic circuit to a suitable power source; engaging a suitable applicator to the circuit in a functional manner; powering the circuit on; and placing the applicator in contact with an area of the body of the automotive vehicle to which it is desired to apply heat; and if required, moving the applicator along the body until a desired result is achieved.

DESCRIPTION OF THE PREFERRED EMBODIMENTS

Figure 1:
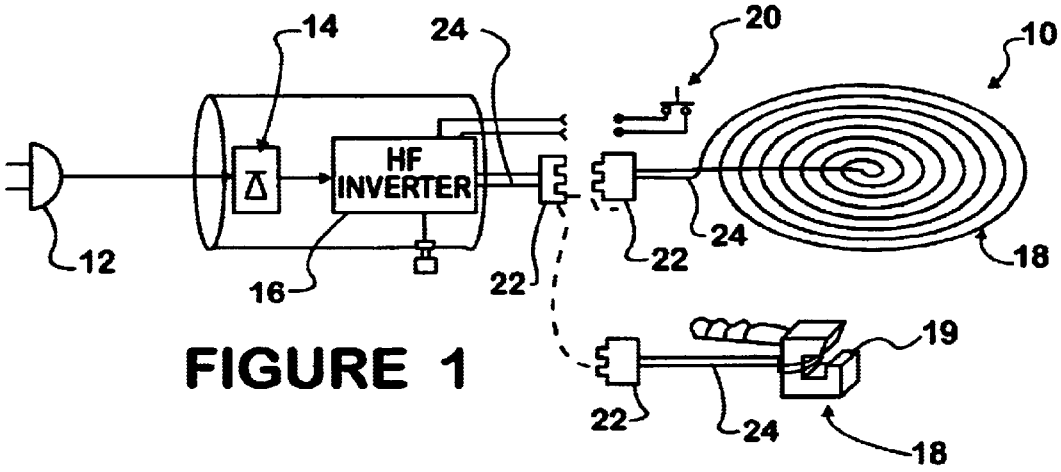
FIG. 1 is a perspective view of a first embodiment of the eddy current/hysteretic heater apparatus of the present invention.

Referring now to the drawings in greater detail, there is illustrated therein an eddy current/hysteretic heater apparatus made in accordance with the teachings of the present invention and generally identified by the reference numeral 10.

As illustrated, the apparatus 10 includes structure 12, such as a plug 12, for engaging the apparatus 10 to a source of electrical power (not shown), preferably ordinary AC line power. A rectifier 14 is provided for converting the AC power from the source into DC power. The DC power may contain a natural ripple frequency at twice the line frequency rate or may be filtered to remove some or all of the ripple. A high frequency invertor 16 of push-pull, half-bridge, full bridge or single-ended variety, either resonant or not is also provided. An applicator 18 is functionally engaged to the invertor 16 for applying a high frequency magnetic field to any metallic automotive structure to be heated for obtaining a desired result, as will be described hereinafter. Also, a switch 20 is provided for use in activating the apparatus 10.

It will be understood by those skilled in the art that circuitry is generically described inasmuch as, for example, bidirectional high-speed switching devices and invertors exist which would eliminate the need for a separate rectifier and thus the use of same as a modification should be regarded as functionally equivalent.

In operation of the apparatus 10, the AC power is delivered to the rectifier 14 wherein it is converted to DC power of substantially the same or a higher DC voltage and may be filtered as in a preferred embodiment to remove ripple components, or not.

This DC power is then delivered to the high frequency invertor 16, wherein the power is converted to high frequency current, typically in the range of 5 to 500 KHz. The high frequency current is then delivered to a selected applicator 18 wherein it is transformed into a high frequency magnetic field.

When the applicator 18 is brought into close proximity with a non-magnetic metallic object (not shown), a similar, but opposing, high-frequency current is developed within the object through known transformer action and a current flows within and through the object, generating heat within the object through natural resistance.

If the metallic object is of magnetic or ferrous nature, an additional action of heating, known as magnetic hysteresis heating, occurs wherein rapidly changing high frequency flux causes magnetic domains within the metal to "rub" against each other, generating heat in a manner analogous to that caused by friction.

The applicators 18 are proposed to be of two handheld manipulatable general embodiments. A first embodiment comprises planar, flexible structure, preferably in the form of a pad 18, for heating of relatively large areas of sheet metal with flat or compound-curved surfaces. A second embodiment of applicator 18 includes a flux-concentrator work coil 19 employing a ferrite, or other suitable magnetic material having a magnetic permeability substantially greater than air, and having an air gap 21 in the magnetic circuit, with the flux density being greater than if the same coil 19 were similarly energized, but without the core 23. This latter coil 19 of the secondary embodiment is used for intense heating of rusted nuts and bolts and the like (not shown) to facilitate disassembly, and to locally heat small areas of sheet metal in certain body-work operations, such as in hail dent removal.

Figure 2:
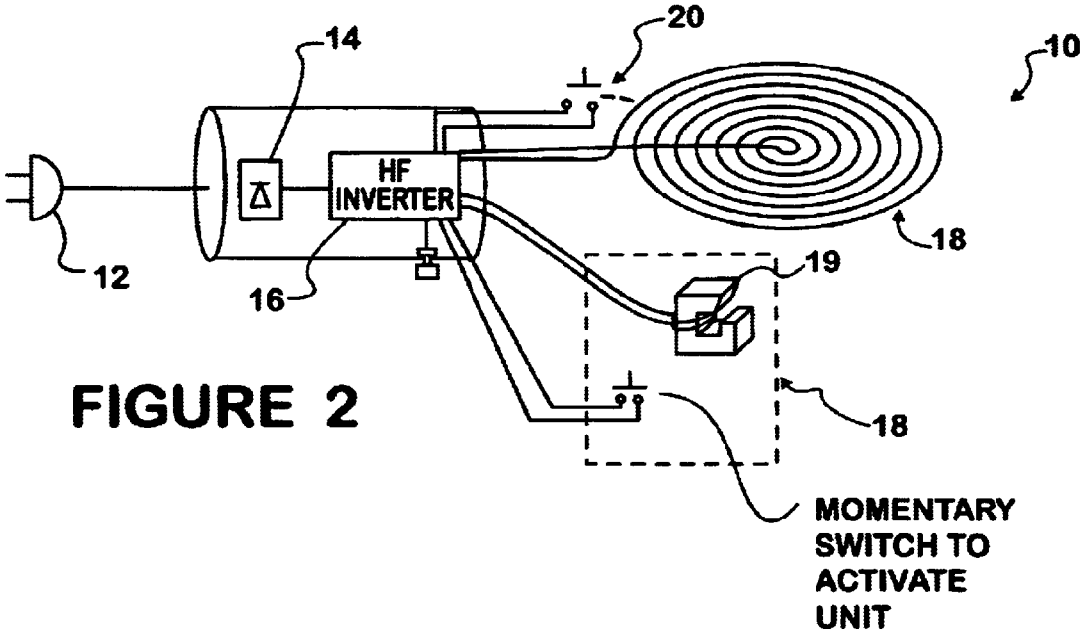
FIG. 2 is a perspective view of a second embodiment of the eddy current/hysteretic heater apparatus of FIG. 1.

In one embodiment of the apparatus 10, connectors 22 are inserted in a cable 24 between the invertor 16 and the work coil 19, to allow for exchanging of one applicator 18 for another. In another embodiment of the apparatus 10 shown in FIG. 2, both applicators 18 are permanently attached to the invertor 16, thus saving on the cost of connectors, reducing bulk, and reducing shock hazard.

Figure 3:
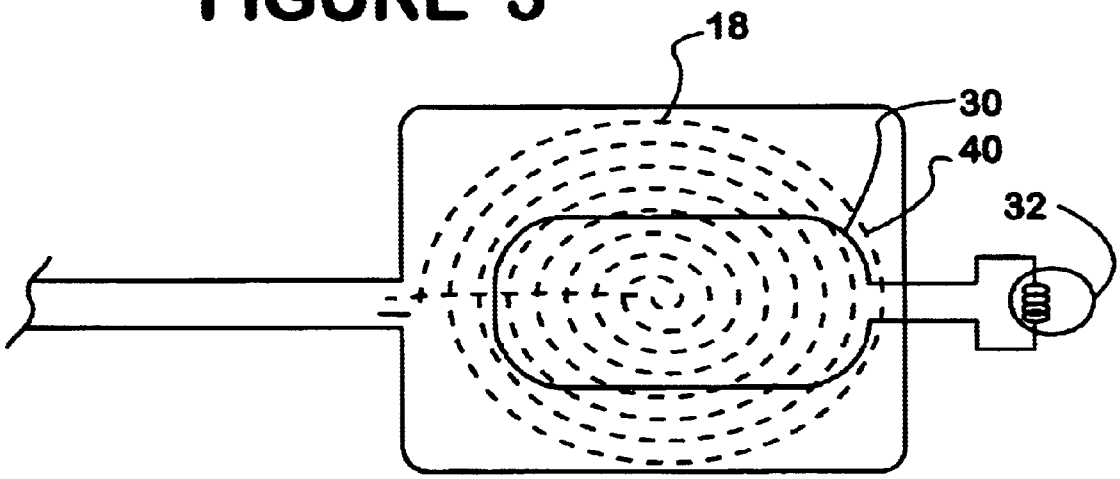
FIG. 3 is an enlarged view of one applicator of the eddy current/hysteretic heater apparatus, the applicator comprising a flexible pad.
Figure 4:
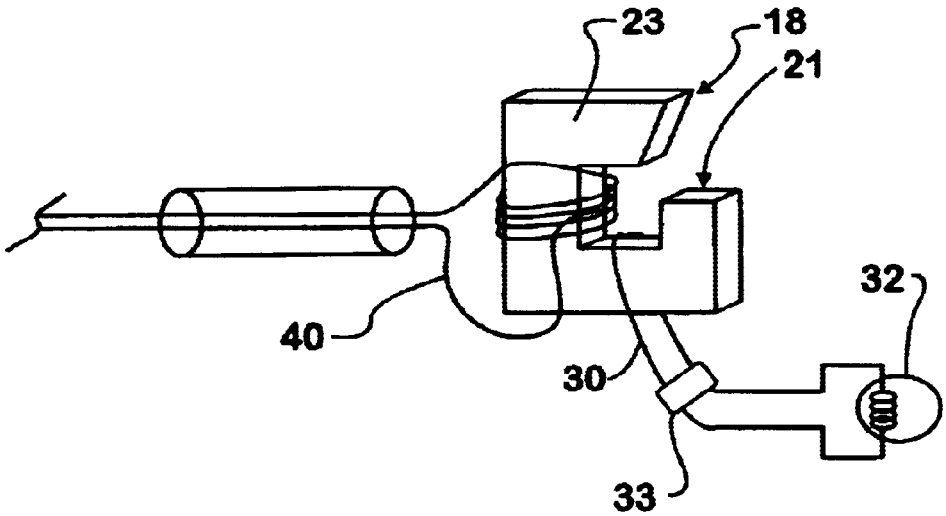
FIG. 4 is an enlarged view of another applicator comprising a magnetic structure having an air gap for delivering a concentrated level of heat.

Referring to FIGS. 3 and 4, it can be seen that a simple loop of wire 30 may be incorporated into either the pad 18 or concentrator tip 18 to deliver a small, high frequency voltage by known transformer action for the illumination of an electric lamp 32, or other indicia for indicating an "on" or energized condition for the applicator 18. A small lamp 32 may serve only to indicate that the applicator 18 is energized, while a larger lamp 32 could serve not only to indicate energization but could also serve as a light source to illuminate the work area.

A voltage regulator 33 may be inserted between leads 40 of the applicator and the lamp loop 30 to maintain light output substantially constant while drive frequency is varied to change the power level, if such capability is incorporated into the apparatus 10, and/or loading on the applicator 18 is varied.

Figure 5:
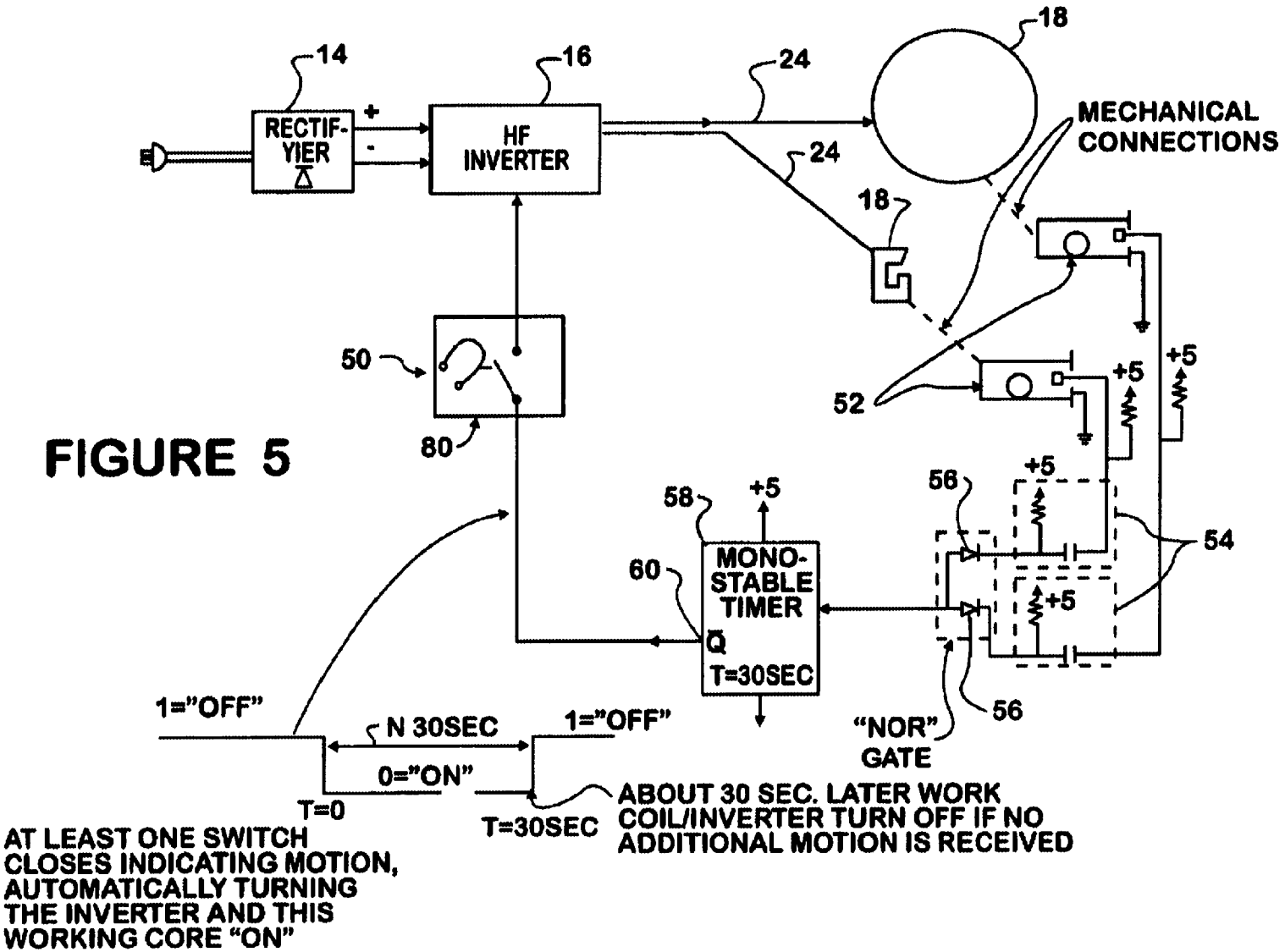
FIG. 5 is a schematic diagram of one generic embodiment circuitry of the eddy current/hysteretic heater apparatus.

In FIG. 5, a first ancillary circuit 50 for the apparatus 10 is shown, applicable to either embodiment thereof, but particularly to that in which both applicators 18 are permanently attached.

Instead of a simple on/off switch 20 for use in controlling the power on/power off function for the apparatus 10, which would need to be (inconveniently) maintained on by the operator during use, one or more motion or vibration activated switches 52 are incorporated mechanically into each applicator 18 or into the cable 24 adjacent each applicator.

As either applicator 18 is hand held in use, at least some occasional movement or vibration occurs, randomly opening and closing the available switch 52.

Differentiators 54 are shown to be provided, which convert switch 52 closings into narrow, low going pulses for causing conduction in their respective diodes 56, delivering low-going pulses into a monostable timer 58 such as a 74121, if either applicator 18 is moved. These pulses trigger the timer 58, which in response to at least one such pulse, is activated and causes its "Q" output 60 to go low for a predefined duration, such as 30 seconds, automatically activating the apparatus 10 in response to sensed motion or vibration.

In this way, if an applicator 18 is inadvertently set down on a metallic object and the user walks away, the invertor 16 is deactivated at the end of the predefined duration, shutting off the apparatus 10.

Figure 6:
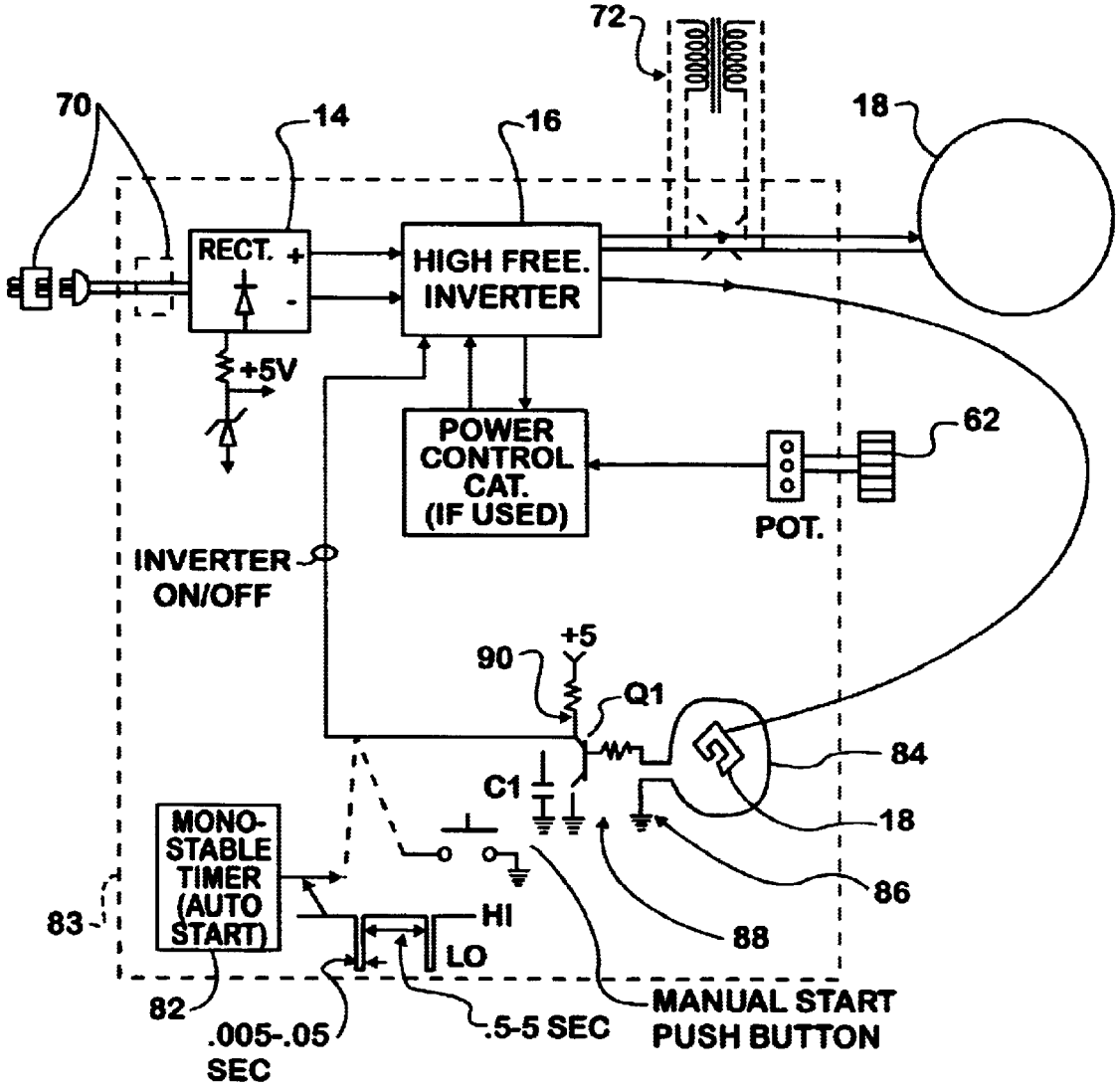
FIG. 6 is another schematic diagram of another generic embodiment of circuitry of the eddy current/hysteretic heater apparatus.

In FIG. 6, other ancillary features are shown. For example, a user operated power control 62 controls the average power delivered to the applicators 18 by varying the drive frequency for a resonant invertor 16, with power reduction being accomplished by progressively increasing (preferred), or decreasing, the drive frequency away from resonance.

In the case of use of a non-resonant invertor 16, frequency may be similarly varied to control power instead.

In either case, power may be controlled by changing the invertor drive waveform from a symmetrical 50/50% duty cycle (if the invertor 16 topology chosen uses more than one switching device (not shown)) where maximum power is delivered, to a progressively asymmetrical drive waveform where very little power delivery occurs, (e.g. with one transistor conducting 95% of the time and the other transistor conducting 5% of the time, with a half-bridge resonant converter delivering only 3–5% of full power).

Additionally, power control may be effected by running the invertor 16 at full power, but switching the invertor 16 on and off at a lower frequency than that of the switching action itself, with the duty cycle of the low frequency being varied from 0 to 100% to achieve similar control of average heating power, with suitable low frequencies being in the 2–60 Hz range.

Still other features shown in FIG. 6 relate to electrical characteristics of the disclosed apparatus 10.

In a typical body shop/garage environment, damp to wet concrete floors and grounded metallic objects such as automotive vehicles on lifts are commonplace. While the applicators 18 and cables 24 are insulated, insulation may fail as is known, potentially creating an electric shock risk. There are two methods for preventing such potential. One method comprises the inclusion of a standard ground fault interrupter module 70 between the AC source and the input rectifier 14 of the apparatus 10. Another method comprises the inclusion of a high frequency isolation transformer 72 between the invertor 16 and each applicator 18.

Additional features applicable to the embodiment of the apparatus 10 in which both applicators 18 are permanently attached to the invertor 16 are also shown in FIG. 6.

It is desirable, from a cost, weight and bulk standpoint, to allow both applicators 18 to be simultaneously energized to prevent the need for any high-power switches and/or relays for switching from one applicator 18, to the other applicator 18, and accommodation is feasible inasmuch as an energized applicator 18 when isolated from any conductive/magnetic object, consumes little power. If, however, an energized but unused applicator 18 should inadvertently come in contact with a metallic object, known potential risks may arise.

A simple hook switch 80 may be provided, such that the weight of either applicator 18 thereon will activate the apparatus 10 and allow use of the opposite off hook applicator 18. All switches, being electromechanical devices, are known to eventually fail and are subject to unwanted operator override/defeat.

A simple solution for insuring that the unused applicator 18 is positioned properly, without the use of a hook switch, is shown at the bottom of FIG. 6. A simple monostable multivibrator 82 such as a 555 timer, periodically produces brief, low-going pulses that command the invertor 16 to turn on at a low duty cycle not exceeding a few percent of the maximum duty cycle, an average power low enough to eliminate any significant risk potential.

If the operator has not properly installed the unused applicator 18 in the prescribed manner in or on a housing 83 of the apparatus 10, in sufficient proximity to the wire loop

84, transistor Q1 never turns on, and the invertor 16 continues to operate at a low, safe duty cycle.

Once the operator recognizes his omission and returns the unused applicator 18 to the safe location, in proximity to the loop 84, a small portion of the magnetic field from the applicator 18 during brief invertor "on" pulses, induces a small voltage on the loop 84 which is fed by way of a current limiting resistor 86 to a base-emitter junction 88, turning transistor 90 on and off at the invertor 16 high frequency rate. This action keeps capacitor C1 in a discharged condition, maintaining the invertor 16 on/off line voltage low, enabling the invertor 16 continuously,as long as the unused applicator 18 remains in the safe location. Such an applicator 18 switching system may be employed in additional to, or in place of, functionally corresponding structures described above.

As described above, the heater apparatus 10 and method for using same provide a number of advantages, some of which have been described above and others of which are inherent in the invention. Also modifications may be proposed to the teachings herein without departing from the scope of the invention. Accordingly the scope of the invention is only to be limited as necessitated by the accompanying claims.

What is claimed is:

1. An eddy current/hysteretic heater apparatus used in automotive repair comprising at least an eddy current/hysteretic circuit engaged to a source of power and having a plurality of hand held, manipulatable applicators functionally engaged to the circuit for use in applying heat generated by the circuit to desired areas of an automotive vehicles, and a controller for allowing only one such applicator to be in use at a time.

2. The apparatus of claim 1 having at least two applicators.

3. The apparatus of claim 2 wherein the applicators are interchangeable in the connection of each to the eddy current/hysteretic circuit.

4. The apparatus of claim 2 wherein both applicators are simultaneously engaged to the eddy current/hysteretic circuit.

5. The apparatus of claim 2 wherein a first applicator comprises a flexible pad for accommodating substantially all configurations of automotive vehicle body areas.

6. The apparatus of claim 2 wherein a second applicator comprises a magnetic structure having an air gap for delivering a concentrated level of heat to a mechanical part of an automotive vehicle.

7. The apparatus of claim 2 wherein each applicator includes indicia for indicating an on condition of the applicator.

8. The apparatus of claim 1 wherein one of the plurality of applicators is a maintained in motion by manual manipulation over the desired area of the automotive vehicle to apply heat to the entire desired area and wherein a sensor which turns the applicator off when no motion is sensed over a predetermined time period.

9. The apparatus of claim 1 further comprising a high-frequency isolation transformer functionally engaged between the eddy current/hysteretic circuit and the plurality of applicators.

10. The apparatus of claim 1 including a housing for containment of the eddy current/hysteretic circuit and the plurality of applicators when the heater structures are not in use.

11. The apparatus of claim 10 further including a structure for engaging the apparatus to a source of electrical power.

12. The apparatus of claim 11 wherein the structure for engaging the apparatus to the source of power incorporates a ground fault interrupter module.

13. An eddy current/hysteretic heater apparatus used in automotive repair consisting essentially of an eddy current/hysteretic circuit having a plurality of compact, hand-held applicators and a controller for allowing only one applicator to be functionally engaged thereto to the circuit at a time, and a high frequency power supply connected to the circuit, the power supply further connected to a source of power, for use in applying heat to a desired area of an automotive vehicle.

* * * * *